United States Patent [19]

Roy

[11] 4,050,117

[45] Sept. 27, 1977

[54] EASEL HINGE CONSTRUCTION

[75] Inventor: Leo T. Roy, South Attleboro, Mass.

[73] Assignee: Craft, Inc., South Attleboro, Mass.

[21] Appl. No.: 721,177

[22] Filed: Sept. 7, 1976

[51] Int. Cl.[2] ..... E05D 1/04

[52] U.S. Cl. ..... 16/178

[58] Field of Search ..... 16/128 R, 171, 172, 16/178, 179, 189, 191

[56] References Cited

U.S. PATENT DOCUMENTS

| | | | |
|---|---|---|---|
| 2,811,741 | 11/1957 | Miller et al. | 16/191 |
| 2,857,618 | 10/1958 | Jordan | 16/191 X |
| 3,080,603 | 3/1963 | Spiselman | 16/191 |
| 3,994,045 | 11/1976 | Roy | 16/178 |

*Primary Examiner*—G. V. Larkin

*Attorney, Agent, or Firm*—Salter & Michaelson

[57] ABSTRACT

An easel hinge for supporting picture frames and the like comprising an outer hinge plate and an inner hinge plate, both having curled barrels, the inner barrel being positioned within the outer barrel for relative rotational movement therewith without the use of a separate hinge pin. The outer barrel is constructed with relativey open and relatively closed portions, the relatively closed portions adapted to pass through an opening or openings provided in the inner plate so as to more completely encompass at least portions of the inner curl within the outer curl so as to produce a stronger hinge, i.e. one which is extremely difficult to be forced open beyond its predetermined limit.

10 Claims, 11 Drawing Figures

EASEL HINGE CONSTRUCTION

BACKGROUND OF THE INVENTION

This invention is an improvement over my copending application Ser. No. 603,788 filed Aug. 11, 1975, now U.S. Pat. No. 3,994,045. As such, it is directed to a hinge of the type permitting a limited relative angular separation between the plates thereof, and in which no separate hinge pin is used to assemble or to hold such plates in operative position. Such hinges, although of general utility, have special application in the interconnection and support and backing of an easel-type picture frame. Accordingly, they are generally referred to as easel hinges.

My above referred to application discloses a highly desirable easel hinge construction in which inner and outer hinge plates, both having curled barrels, are assembled for relative rotational movement with respect to each other. The barrel of the outer plate is of relatively open configuration so as to permit the more closed configured inner barrel to be assembled therewith by means of a relative longitudinal positioning movement. While of simple construction and readily formable by automatic machinery, the relatively open configuration of the outer hinge barrel permits, under some circumstances, as when the respective plates are forcibly pressed apart beyond their predetermined limit, the forced removal of the inner barrel from its enveloping position within the outer barrel through the relatively open slot which exists in the latter, such slot being necessary to permit the angular separation of the respective hinge plates. Accordingly, it has been found desirable to provide a construction having the attributes of the above discussed easel hinge construction, that is, of simple, low cost construction and which can be readily made and assembled on automatic machinery, but which additionally will not permit a relative separation of the hinge plates by the forced passage of the inner barrel through the opening provided in the outer barrel when such plates are subjected to heavy opening forces.

SUMMARY OF THE INVENTION

The present invention accomplishes this above indicated aim by the provision of an easel hinge comprising an outer hinge plate and an inner hinge plate directly interconnected to each other by means of inner and outer barrels provided thereon, which barrels are disposed within one another. Specifically, an inner hinge leaf portion is provided with one or more openings therethrough which are adapted to receive projecting outer barrel tongue portions so as to provide at least one, and preferably a plurality of, closed curl outer barrel portions which, in essence, completely wrap around underlying portions of the inner barrel so as to prevent possible separation therebetween. Arcuate or angular opening movement between the relatively positioned plates is permitted by relatively open outer barrel portions which are in turn spaced from the inner side of the outer hinge plate and serve to form a stop by means of abutting contact therewith by the inner hinge plate at the outer extent of the arcuate movement permitted between the two hinge plates.

It is therefore a primary object of the instant invention to provide an easel hinge which is of simple, low cost construction that can be readily made and assembled by automatic machinery and which will not permit the forced separation of inner and outer barrel portions forming such hinge construction.

A further object of the present invention is the provision of an easel hinge construction in which portions of an outer enveloping barrel are of a relatively closed curled configuration so as to prevent the removal therefrom of an inner barrel portion when the respective hinge plates thereof are forceably arcuately separated.

A still further object of the present invention is a provision of an easel hinge construction in which at least one, and preferably a plurality of tongues forming relatively tight curled outer barrel portions project entirely through openings provided in the body of an inner hinge, which inner hinge in turn has an inner barrel disposed within said outer barrel so as to cooperatively not only form a stronger hinge construction, but one which automatically provides for a positive stop in the amount of relative arcuate opening movement permitted between the hinge members thereof.

A still further object of the present invention is the provision of an easel hinge construction of the immediately aforementioned type, wherein specific means are provided for the drainage of plating solution from between the respective plates thereof when positioned in face-to-face contact with each other.

Other objects, features, and advantages of the invention will become apparent as the description thereof proceeds when considered in connection with the accompanying illustrative drawing.

DESCRIPTION OF THE DRAWING

In the drawing, which illustrates the best mode presently contemplated for carrying out the present invention.

DESCRIPTION OF THE INVENTION

Figure 1:
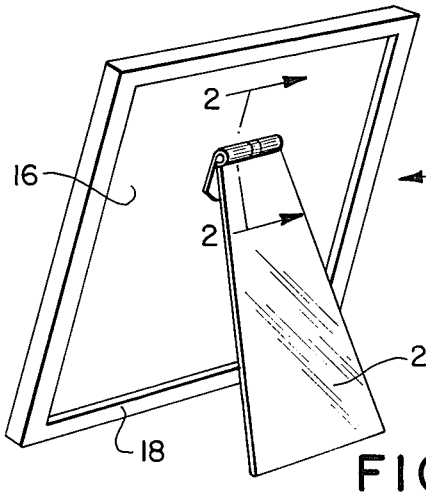
FIG. 1 PRIOR ART
FIG. 1 is a perspective view of an easel hinge constructed in accordance with my previously described invention and accordingly representative of prior art.
Figure 2:
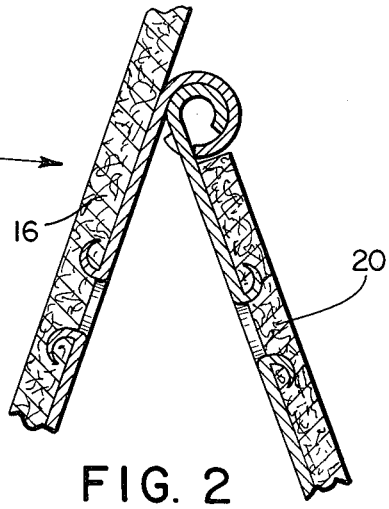
FIG. 2 is an enlarged sectional view taken along the line 2—2 of FIG. 1.

Referring now to the drawing, and in particular, the prior art representation indicated by FIGS. 1 and 2 thereof, it may be apparent that when the respective hinge plates thereof are forceably moved apart, the possibility exists for the inner barrel to move downwardly to the left as depicted and move through the open slot provided by the relatively open curl of the outer barrel. It is this potential separation between the individual hinge members that the present invention is primarily directed to prevent. The easel hinge 10 depicted in FIGS. 3 through 9 of the drawing includes an inner hinge plate 12 and an outer hinge plate 14, and as with previous constructions of this general type, is adapted to connect the backing 16 of frame 18 to a support leg 20.

Figure 8:
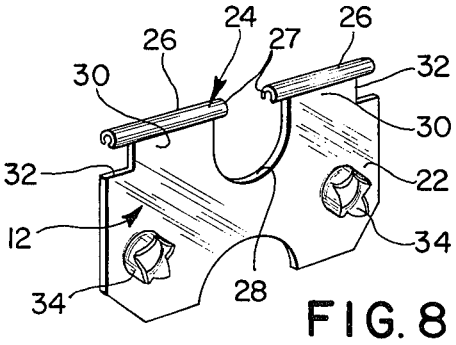
FIG. 8 is a front perspective view depicting the inner hinge plate of the present hinge construction.

The construction of the inner hinge plate 12 may be best seen by reference to FIG. 8, wherein an inner leaf portion 22 is provided at one end thereof with an inner barrel 24 of relatively tight curled configuration and, as depicted, made up of two separate end segments 26 spaced from each other by means of a central opening 28 of generally open-top U-shaped configuration. Such opening 28, although necessarily passing through the entire thickness of the inner leaf 22, need not be of the particular shape indicated nor need such serve to separate the inner barrel 24 into spaced segments 26, such spaced configuration primarily serving to facilitate the positioning of known automatic machinery utilized to form such tight curled constructions from the sheet metal materials generally preferred in forming the present hinge construction. The invention is not, however, so limited and other relatively thin, stiff sheet materials such as plastics and reinforced or impregnated paper products would also be suitable. As will be noted, the inner edges 27 of segments 26 project inwardly beyond the outer opposite edges of opening 28.

Figure 5:
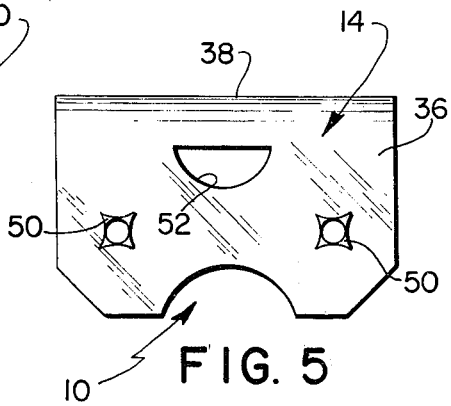
FIG. 5 is a rear plan view of such novel assembled hinge construction.
Figure 9:
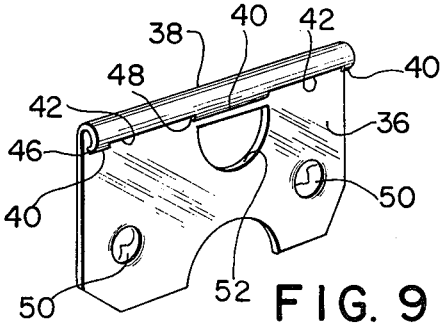
FIG. 9 is a perspective view showing the outer hinge plate of the present hinge construction.

Returning to the construction of the inner hinge 12, the separate barrel portions of segments 26 thereof are connected to the leaf portion 22 thereof by means of connecting webs 30. The inner leaf 22 is further preferably provided with a pair of edge openings in notches 32 disposed inwardly of either side edge thereof and adjacent to the connecting webs 30. Additionally, suitable rosettes 34 may be provided for attachment, as indicated, to the supporting leg 20 of the easel depicted in FIGS. 1 and 2. Turning now to FIGS. 5 and 9, the construction fo the outer hinge plate 14 is best depicted. Therein such includes an outer leaf 36 in turn provided with an outer barrel 38 at one end thereof. The barrel 38 in turn is provided with relatively closed and relatively opened barrel portions 40 and 42 respectively, it being further apparent that the relatively closed portions are particularly formed by a pair of projecting edge tongues 46 and a centrally disposed tongue 48 which project from the terminal edge of the outer curl or barrel 38 inwardly towards the inner surface of the outer leaf 36 to a position either proximal or in contact therewith. The open barrel portions 42 in turn are disposed between such tongues 46, 48 and thus terminate in a longitudinally directed edge portion which is substantially spaced from the inner surface of the outer leaf 36. It is this spacing that permits the relative arcuate positioning of the hinge plates 12 and 14, as hereinafter will be made more apparent. The outer hinge plate 36 is also provided with rosettes 50 similar to rosettes 34 of hinge plate 22 for the purpose of connecting to the backing portion 16 of the frame 18, as is known in the art. Additionally an opening 52 of a configuration preferably at least partially conforming to that of opening 28 is formed within the outer hinge leaf 36.

Figure 3:
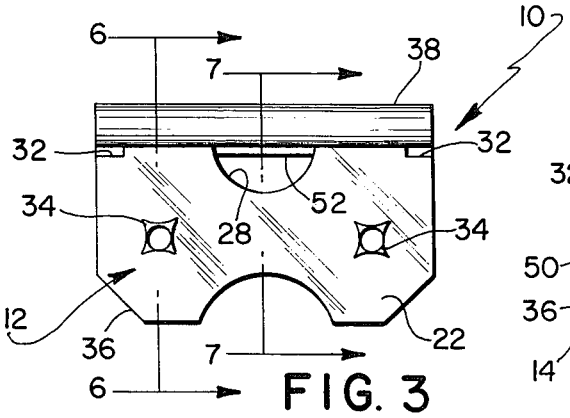
FIG. 3 is a front plan view of the easel hinge of the present invention in assembled condition.
Figure 4:
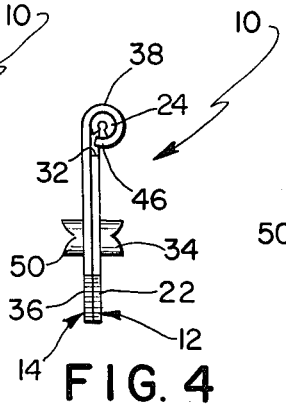
FIG. 4 is a side view thereof.

In assembling the hinge plates 12 and 14 to form the hinge construction 10 of the present invention, and as generally depicted in FIGS. 3 through 5 of the drawing, the inner hinge plate 12 in the fully formed configuration shown may be disposed in contiguous face-to-face relationship with the outer hinge plate 36 having its barrel portion 38 in generally unformed, that is, in a uncurled attitude. Thereafter while so positioned the outer barrel 38 is formed by any know curling techique so as to enable those portions of the barrel 38 forming the closed portion or portions 40 thereof to inwardly project through the opening or openings 28, 32 provided in the inner hinge leaf 22. In the preferred embodiment depicted in the drawing, such aligned assembly of the hinge plates 12 and 14 enables tongue 48 to project through the upper portion of the opening 28 and be disposed so that the side edges thereof are either in contact with or in close proximity to the side edges forming the opening 28. In this manner then, the projection of the tongue 48 through the opening 28 not only serves to form at least one relatively tightly closed outer barrel portion 40 which more tightly envelops underlying portions 27 of the inner barrel 24, but further serves as a means for preventing relative longitudinal movement between the hinge plates 12 and 14.

In such assembled position, the tongues 46 additionally project through the openings 32 so as to provide the desired tight enveloping positioning of the outer barrel 38 about the inner barrel 24 at a plurality of spaced locations along the longitudinal extent thereof. In this way, then, the extent of any open slot between the terminal edge portions of the relatively closed portions 40 of the outer barrel 38 and the inner surface of the outer leaf 36 is either reduced or eliminated so that the inner barrel 24 is positioned therein in a highly secure manner.

Figure 6:
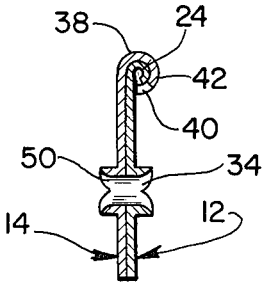
FIG. 6 is a side sectional view taken along the line 6—6 of FIG. 3.
Figure 6A:
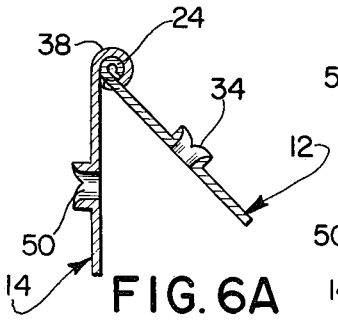
FIG. 6A is an illustration similar to FIG. 6, but in full open position.
Figure 7:
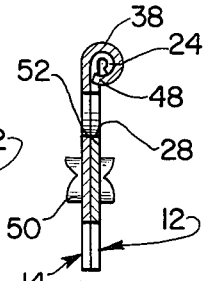
FIG. 7 is a side sectional view taken along the line 7—7 of FIG. 3.
Figure 7A:
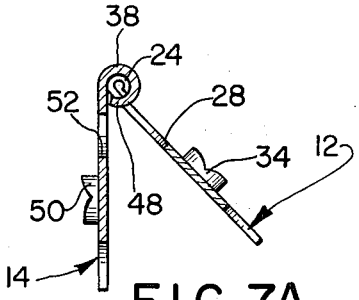
FIG. 7A is a view similar to FIG. 7, but shown in full open position.

Referring now to FIG. 4 of the drawing, the projection of one of the side tongues 46 in part comprising the relatively closed portion of the outer curl 38 is shown clearly projecting through one of the edge openings 32 provided in the leaf 22 of the inner hinge plate 12. FIG. 7, on the other hand, depicts the centrally disposed tongue 48 projecting through opening 28 so as to provide the above described secure engagement of the barrels 28, 38 in such central location. It should be thus clear that the relative arcuate movement of the hinge plates 12 and 14 with respect to each other is in no way interfered with by the projection of the tongues 46, 48 respectively into the openings 32 and 28. The arcuate positioning of the hinges 12, 14 is however, determined i.e. limited by the abutment of outer portions of the inner leaf 22 that is, the connecting web portions 30 thereof, with those portions of the longitudinal free edge of the barrel 38 forming the relatively open portions 42 thereof. Such coaction is best shown by reference to FIGS. 6A and 7A of the drawing, the terminal edge 42 thereof being clearly shown in FIG. 6A and being obscured from view in FIG. 7A.

After assembly of the hinge plates 12 and 14 as previously described, the hinge 10 is preferably plated for corrosion resistance purposes, as is conventional. As the hinge plates are normally in flat face-to-face disposition after assembly and during such plating operations, it has been found beneficial to provide an opening 52 within the outer leaf 36. Such opening 52 is aligned with opening 28 so that plating solution will not collect as otherwise would occur on that surface of the leaf 36 immediately beneath the opening 28. Thus, at least the partial alignment of the openings 52 and 28 in the plates 12 and 14 enables plating solution to more quickly and positively drain from the hinge construction 10. Similar openings in the outer leaf 36 could be provided for alignment with openings 32 if such were found necessary to insure complete drainage although such is unlikely to be required since openings 32 extend outwardly to the side edges of the inner leaf 22.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An easel hinge comprising an outer hinge plate and an inner hinge plate directly interconnected to each other for relative arcuate movement therebetween without a hinge pin, said outer hinge plate having a relatively flat leaf portion terminating in a curled barrel at one end thereof, said inner hinge plate also having a relatively flat leaf portion terminating in a curled barrel at one end thereof, said inner hinge leaf portion having at least one opening therethrough, said opening adjacent to and disposed longitudinally of said inner barrel, said outer barrel terminating in a longitudinal free edge directed towards the inner side of said outer leaf and having at least one portion thereof proximate said inner side to define a closed barrel portion, the remaining portions thereof spaced from said inner side to define an open barrel portion, said closed barrel portion being aligned with and projecting through said inner leaf opening and generally completely enveloping portions of said inner barrel positioned therewithin, while permitting relative rotational movement therewith and preventing longitudinal movement of said plates with respect to each other, such respective barrel positioning also permitting angular separation between said plates from a fully closed position wherein the inner sides of said leaves are face-to-face to a fully open position wherein the outer side of said inner leaf abuts the longitudinal free edge of said outer barrel open portion.

2. In the easel hinge of claim 1, both said barrels being curled in the same direction.

3. In the easel hinge of claim 1, said inner barrel connected to said inner leaf by means of at least one connecting web, said longitudinal free edge of said outer barrel open portion contacting said connecting web in said fully open easel position.

4. In the easel hinge of claim 3, said inner leaf opening being centrally disposed so as to define spaced connecting web portions on longitudinally disposed opposite sides thereof, said outer barrel closed portion comprising a tongue projecting through said opening, said tongue having opposed sides thereof disposed proximal to the side portions of said inner leaf opening.

5. In the easel hinge of claim 4, the top of said opening projecting through said inner barrel to define a pair of longitudinally spaced barrel portions, the opposite inner edges of said spaced portions extending inwardly of opposite side edges of said opening.

6. In the easel hinge of claim 3, said inner leaf having a plurality of openings disposed therein, said outer barrel closed portion comprising a plurality of tongues projecting through said openings.

7. In the easel hinge of claim 6, said inner leaf plurality of openings including a pair of openings at respective edges thereof and a further opening centrally disposed so as to define spaced connecting web portions on longitudinally disposed opposite sides thereof, said outer barrel closed portion comprising a plurality of tongues respectively spaced along said terminal edge thereof for aligned projection into said openings.

8. In the easel hinge of claim 6, the top of said central opening projecting through said inner barrel to define a pair of longitudinally spaced barrel portions, the opposite inner edges of said spaced portions extending inwardly of opposite side edges of said opening.

9. In the easel hinge of claim 8, said outer leaf having an opening of similar configuration to said inner leaf central opening, said leaf openings at least partially superimposed with respect to each other in said closed leaf position.

10. In the easel hinge of claim 9, said inner and outer leaf central openings of generally U-shaped configuration.

* * * * *